United States Patent [19]

Sekine et al.

[11] Patent Number: 4,759,214

[45] Date of Patent: Jul. 26, 1988

[54] METHOD FOR DETERMINING FRACTURE TOUGHNESS OF ROCK BY CORE BORING

[75] Inventors: Hideki Sekine; Hideaki Takahashi; Hiroyuki Abe, all of Sendai, Japan

[73] Assignee: Tohoku University, Sendai, Japan

[21] Appl. No.: 16,362

[22] Filed: Feb. 19, 1987

[30] Foreign Application Priority Data

Jun. 19, 1986 [JP] Japan ..... 61-141358

[51] Int. Cl.[4] ..... E21B 49/02

[52] U.S. Cl. ..... 73/153; 73/799

[58] Field of Search ..... 73/153, 784, 799; 364/508

[56] References Cited

U.S. PATENT DOCUMENTS 2,555,275 5/1951 Millison ..... 73/153 X

OTHER PUBLICATIONS

Abou-Sayed, A. S., An Experimental Technique . . . Stress Conditions, 6th Int. Conference on Exp. Stress Analysis, Munich, Germany, 1978, pp. 819–824.

*Primary Examiner*—Jerry W. Myracle

*Attorney, Agent, or Firm*—Fleit, Jacobson, Cohn & Price

[57] ABSTRACT

The disclosed method introduces a pressure effectivity factor h, so as to continuously determine fracture toughness $K_{IC}$ of rock during core boring by using the equation of $$K_{IC}=0.346\sqrt{N/\epsilon L}\cdot hQ/B;\text{ and}$$

here, N is the revolving speed of a coring bit, Q is the pressure supplied to it, L is its drilling speed, B is the width of its bit face, and $\epsilon$ is the number of rows of its face stones. The pressure effectivity factor h is predetermined by using both a core whose fracture toughness is measured by the ISRM (International Society for Rock Mechanics) method and the above constants which are used in boring the core.

1 Claim, 6 Drawing Sheets

METHOD FOR DETERMINING FRACTURE TOUGHNESS OF ROCK BY CORE BORING

BACKGROUND OF THE INVENTION

1. Field of the Invention

This invention relates to a method for determining toughness against fracture (to be referred to as "fracture toughness", hereinafter) of rock by a core boring, which method is particularly useful as a means for logging of underground rock.

To exploit geothermal energy from hot dry rock, engineering to facilitate the design of underground heat-exchange surface (crack surface) is necessary. Knowledge of the fracture toughness of rock is indispensable for such engineering because it is one of the most fundamental physical properties which rule behavior of underground cracks.

2. Description of the Prior Art

ISRM (International Society for Rock Mechanics) proposes a core test method for determining fracture toughness of underground rock by using a core bored therefrom. This test method allows the use of either of two types of test piece; namely a three-point bending test piece CB with a chevron notch as shown in FIG. 1A and FIG. 1B, and a short rod test piece SR with a chevron notch as shown in FIG. 1C and FIG. 1D. Stress intensity factor K of the test piece is given as follows. For the three-point bending test piece CB:

$$K=0.25(S/T)Y_c'F/T^{1.5} \quad (1)$$

For the short rod test piece SR:

$$K=fF/T^{1.5} \quad \ldots\ldots (2)$$

Here, T is the diameter of the test piece, S is the spacing between support points of the test piece, F is the load to the test piece, and $Y_c'$ and f are correction factors.

The core test method of ISRM provides for two levels, i.e., level I and level II, from the standpoint of the ease of testing procedure.

The philosophy of the level I test for evaluating the fracture toughness assumes that a crack propagates with a constant value of the stress intensity factor K at the tip of the crack, and the fracture toughness is determined at an evaluating point where the above corrections factors $Y_c'$ and f are minimized or a maximum load $F_{max}$ is applied. Crack length $a_c$ at the evaluating point depends only on the shape of the test piece. The level I test gives the following fracture toughness $K_{CB}$ or $K_{SR}$ for the above test piece.

$$K_{CB}=A_{min}F_{max}/T^{1.5} \quad (3)$$

$$K_{SR}=24.0F_{max}/T^{1.5} \quad (4)$$

Here, $$A_{min}=0.25(S/T)[7.34+28.6(t_0/T)+39.4(t_0/T)^2]$$

In the level II test, non linearity correction is applied to the fracture toughness $K_{CB}$ and $K_{SR}$ obtained by the level I test. It is proposed to determine an evaluating point load $F_c$ which corresponds to a critical crack length $a_c$ based on an unloading compliance method. FIG. 2 shows load-displacement ($F$-$\delta_F$) curves for repeated load-unload cycles. Compliance of a test piece at a load stage $F_H$ is defined as the slope of a straight line which passes through both a point H for the load stage $F_H$ and a point L for one-half of the load stage ($0.5F_H$).

Based on such linearized compliance, the evaluating point load $F_c$ and a non-linearity correction factor p are determined, and the fracture toughness $K^c$ after non-linearity correction is calculated by the following equation for both the three-point bending test piece CB and the short rod test piece SR.

$$K^c=\left(\frac{1+p}{1-p}\right)^{\frac{1}{2}}\frac{F_c}{F_{max}}K_{CB(SR)} \quad (5)$$

Here, $p=(\Delta X_0/\Delta X)$.

Thus, the ISRM core test method requires one test piece for each determination of the fracture toughness, e.g., one test piece for each portion of the underground rock. On the other hand, in order to design underground heat-exchange surfaces, knowledge on the distribution of the fracture toughness over a range of underground depth is necessary. The ISRM core test method takes much time and labor for testing one core for determining the fracture toughness at one portion of rock, and this method is not suitable for determining the values of the fracture toughness of underground rock at different portions thereof.

In short, the conventional ISRM core test method has a shortcoming in that it does not provide any means for continuous measurement of the fracture toughness of underground rock over a range of depth.

SUMMARY OF THE INVENTION

Therefore, an object of the present invention is to obviate the above-mentioned shortcoming of the prior art by providing a novel method for continuous measurement of the fracture toughness of underground rock in a simple manner over a range of depth, which method uses data collectable during core boring.

With the method of the invention, the fracture toughness of underground rock can be determined in an on-line manner while a bore-hole is being drilled. Thus, the method provides an important fundamental technique for geothermal exploitation from underground hot dry rock.

In essence, the method of the invention stores physical properties of a core boring machine such as type and dimensions of a coring bit and others, measures operating conditions of the core boring machine such as drilling speed and others, and calculate the fracture toughness of rock based on the thus stored physical properties and the thus measured operating conditions.

More particularly, in a method for determining fracture toughness of rock by a core boring according to the invention, bit face width B of a coring bit of the core boring machine and number of rows $\epsilon$ of face stones on the coring bit are measured and stored on a memory. To facilitate the determination of pressure effectivity factor h of the core boring machine which will be defined hereinafter by referring to the equation (6), the rock fracture toughness is once determined through the ISRM method by using a test piece that is prepared from a core produced by the core boring while measuring and storing the bit revolving speed N of the coring bit, the supply pressure Q thereto, and the drilling speed L when the core is taken.

In accordance with the ISRM method, the fracture toughness $K_{IC}$ of the test piece is determined by applying a load thereto until fracture thereof and measuring the load at the fracture.

The pressure effectivity factor h of the core boring machine is calculated from the thus determined fracture toughness $K_{IC}$ of the test piece by an equation of $$K_{IC}=0.346\sqrt{N/\epsilon L}\cdot hQ/B$$

The pressure effectivity factor h thus determined is stored in the memory.

Further boring is effected at an arbitrary portion of the rock by the core boring machine, and the value of fracture toughness $K_{IC}$ of the rock at the arbitrary portion is determined by calculation of the above equation while using the stored values of the bit face width B, the number of rows $\epsilon$ of face stones, and the pressure effectivity factor h, as well as measured values of the bit revolving speed N, the supply pressure Q, and the drilling speed L thereat.

BRIEF DESCRIPTION OF THE DRAWINGS

For a better understanding of the invention, reference is made to the accompanying drawings, in which

FIG. 7 is a graph showing the variations of the maximum intensity of singularity of circumferential stress K and the fracture toughness $K_{IC}$ with increase of the crack length a;

Figure 1A:
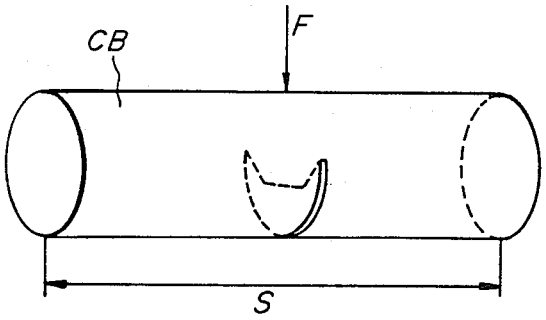
FIG. 1A is a schematic perspective view of a three-point bending test piece CB.
Figure 1B:
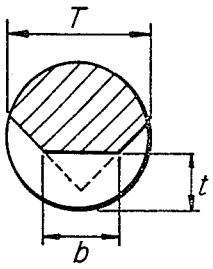
FIG. 1B is a sectional view of the test piece CB at a chevron notch thereof.

Throughout different views of the drawing, 1 is a coring bit such as a diamond coring bit, 2 is a shank, 3 is a gauge stone, 4 is a face stone, 5 is a kicker stone, 6 is a water groove, 7 is a matrix, 8 is a drilled surface of rock, 9 is an edge crack, 10 is a horizontal forward crack, and 11 is a horizontal backward crack.

DESCRIPTION OF THE PREFERRED EMBODIMENT

The theory of the method according to the invention will now be described in detail by referring the accompanying drawings.

(I) A rock drilling model and determination of fracture toughness

Figure 3:
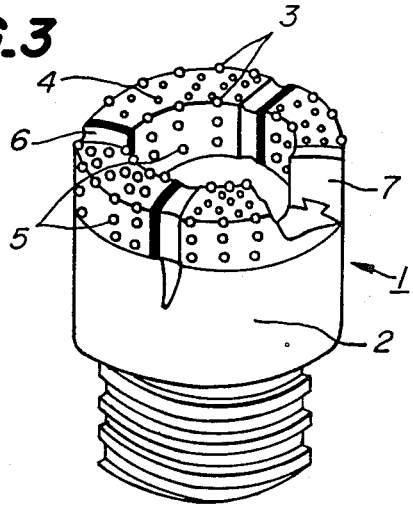
FIG. 3 is a partially cutaway schematic perspective view of a diamond coring bit.
Figure 4:
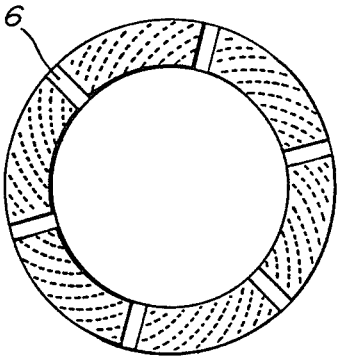
FIG. 4 is an end view of the diamond coring bit, showing the manner in which face stones are embedded thereon.

There are two type of diamond bit which is used as a coring bit 1 in a core boring machine of the invention; namely a surface bit and an impregnate bit. FIG. 3 shows a partially cutaway schematic perspective view of a coring bit 1 which is formed of a surface bit, and FIG. 4 shows the manner in which face stones 4 are embedded on the surface of the coring bit 1. As can be seen from FIG. 4, the face stones 4 are so embedded that they are aligned regularly in rows. In the ensuing analysis, one row of the face stones 4 aligned along a line which extends between inner periphery and outer periphery of the coring bit 1 is treated as a cutter edge for drilling the rock.

If the coring bit 1 has a bit face width B and $\epsilon$ rows of face stones 4 embedded thereon, and if pressure Q is supplied to the coring bit as a total load (to be referred to as "supply pressure"), then the load per unit length of one row of the face stones 4 is given by the following equation.

$$q=(hQ/\epsilon B) \quad (6)$$

Here, h is a pressure effectivity factor which represents that part of the supply pressure Q which is actually applied to the face stones 4.

Figure 5:
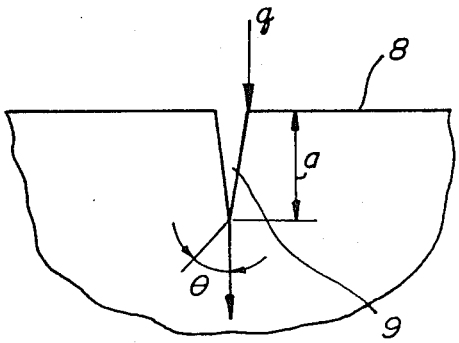
FIG. 5 is a diagrammatic illustration of the relationship between an edge formed of face stones and an edge crack produced on rock surface.
Figure 6A:
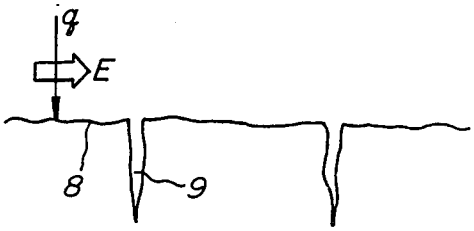
FIG. 6 shows curves (a), (b), (c), (d), and (e) which illustrate the relation between the load moving direction E and the growths of an edge crack 9, a horizontal forward crack 10 and a horizontal backward crack 11.
Figure 6B:
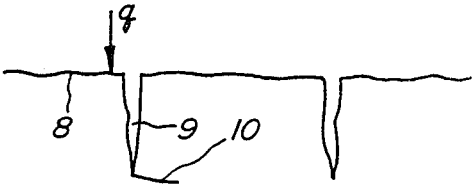
Figure 6C:
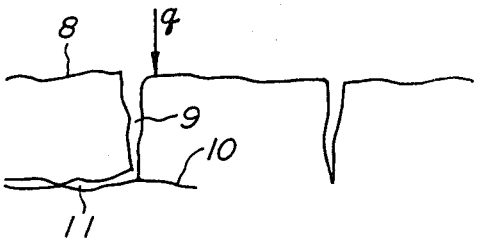
Figure 6D:
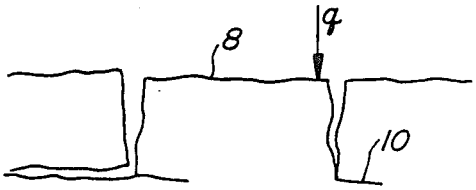
Figure 6E:
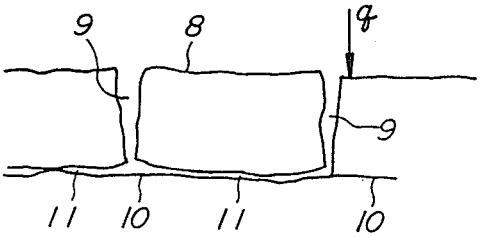

Referring to FIG. 5, a number of small edge cracks 9 are generated on drilled surface 8 of the rock. In the ensuing analysis, it is assumed that the rock be a semi-infinite isotropic and homogeneous elastic medium and the small edge cracks 9 be perpendicular to the surface of the semi-infinite elastic medium. FIG. 5 shows a two-dimensional model of a cutter edge formed of the row of face stones 4 and the edge crack 9. Curves (a) through (e) of FIG. 6 show the process in which rock is drilled by the movement of the cutter edge to which edge a concentrated load q is applied.

More particularly, when the concentrated load q approaches the edge crack 9 on the drilled surface 8 as shown by the arrow E of the curve (a) of FIG. 6, the tip of the edge crack 9 is so kinked as to cause growth of a horizontal forward crack 10 as shown in the curve (b) of the figure. When the concentrated load q passes the edge crack 9 and reaches the position as shown in the curve (c) of FIG. 6, a horizontal backward crack 11 is generated in the contrary or rearward direction, and the horizontal backward crack 11 extends to and joins with a previously formed horizontal forward crack 10 so as to cause peeling of a portion of the rock thereat. As the concentrated load q further moves, the horizontal forward crack 10 and the horizontal backward crack 11 similarly grow and ensuing peeling occur as shown in the curves (d) and (e) of FIG. 6. As a result, the rock is drilled.

To analyze the growth of the horizontal backward crack 11 from the tip of the edge crack 9 immediately after the passage of the concentrated load q through the edge crack 9, it is necessary to find the stress intensity factor at the tip of the edge crack 9. Referring to FIG. 5, when the concentrated load q is at a shoulder portion of the two-dimensional edge crack 9 with a length a, the stress intensity factor $K_I$ for mode I and the stress intensity factor $K_{II}$ for mode II at the tip of the edge crack 9 are given as follows.

$$K_I=0,\ K_{II}=1.30(q/\sqrt{\pi a}) \quad (7)$$

According to the Erdogan-Sih's criterion for crack growth, a crack occurs when the maximum value of the intensity of singularity of circumferential stress in the proximity of the crack tip exceeds the fracture toughness, and such crack grows from the crack tip in the direction of the maximum value of the intensity of singularity. Referring to FIG. 5, the above criterion also suggests that the maximum value K of the intensity of singularity of the stress and the angle $\theta$ between the elongation of the edge crack 9 and the direction of the crack growth are given by $$\left.\begin{aligned} K &= \cos(\theta/2)[K_I\cos^2(\theta/2) - (3/2)K_{II}\sin\theta] \\ \theta &= 2\tan^{-1}\left[-\frac{K_I/K_{II} - \sqrt{(K_I/K_{II})^2 + 8}}{4}\right] \end{aligned}\right\} \quad (8)$$

Substitution of the equation (7) in the equation (8) gives $$K=0.847q/\sqrt{a},\ \alpha=70.5^\circ \quad \ldots\ldots (9)$$

When the maximum value K of intensity of singularity of the circumferential stress given by the equation (9) exceeds the fracture toughness $K_{IC}$ of the rock, the edge crack 9 grows. Thus, when the edge crack 9 grows, the excess load K* given by the following equation assumes zero or a positive value.

$$K^* \equiv (K-K_{IC}) \geqq 0 \quad (10)$$

Figure 7:
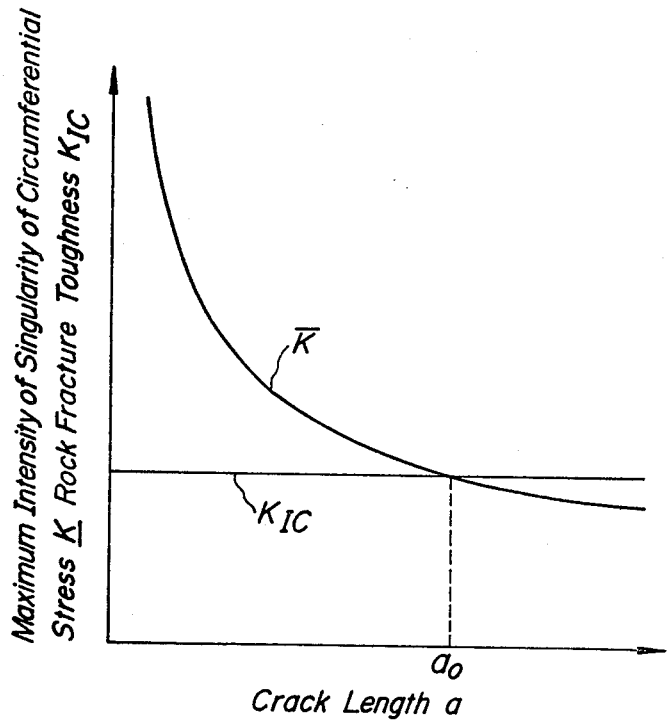

FIG. 7 shows the relationship between the maximum value K of intensity of singularity of circumferential stress and the fracture toughness $K_{IC}$ for different crack lengths a. As can be seen from FIG. 7, the above-mentioned excess load K* increases with decrease of the crack length a. If it is assumed that the probability of the rock peeling is proportional to the excess load K*, the probability density function of occurrence of the rock peeling at the crack length a is given by $$K^*/\int_0^{a_o} K^* da$$

Thus, the mean crack length $a_m$ for producing the rock peeling becomes $$a_m = \int_0^{a_o} aK^* da / \int_0^{a_o} K^* da \quad (11)$$

Here, $a_o$ is the crack length which satisfies the relation of K=0 in the inequality (10), and it is given by $$a_o=0.71q^2/(K_{IC})^2 \quad (12)$$

Substitution of the equations (6), (9), (10), and (12) in the equation (11) gives $$a_m = 0.120\frac{h^2Q^2}{\epsilon^2B^2K_{IC}^2} \quad (13)$$

Accordingly, the drilling rate L, or drilling length per unit time, is given by $$L = \epsilon N a_m = 0.120\frac{Nh^2Q^2}{\epsilon B^2K_{IC}^2} \quad (14)$$

When the operating conditions of the core boring machine including the bit revolving speed N, the supply pressure Q, and the drilling speed L are measured, the fracture toughness $K_{IC}$ can be determined in the following manner by using the equation (14)

$$K_{IC}=0.36\sqrt{N\epsilon L}\cdot hQ/B \quad \ldots\ldots (15)$$

The process for determining the fracture toughness will now be described by referring to the flow chart of FIG. 8. Before the start of actual measurement, the physical properties of the core boring machine, i.e., the bit face width B and the number of rows $\epsilon$ of the face stones 4, are measured and stored in a computer. Depending on weather the above-mentioned pressure effectivity factor h is known or not, either of the following routes is selected.

Figure 1C:
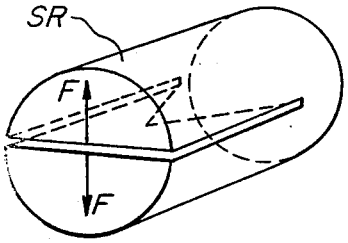
FIG. 1C is a schematic perspective view of a short rod test piece SR.
Figure 1D:
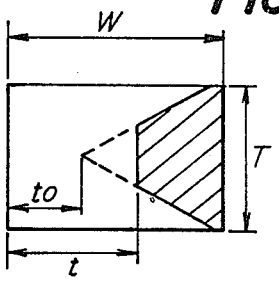
FIG. 1D is a sectional view of the test piece SR at a chevron notch thereof.
Figure 2:
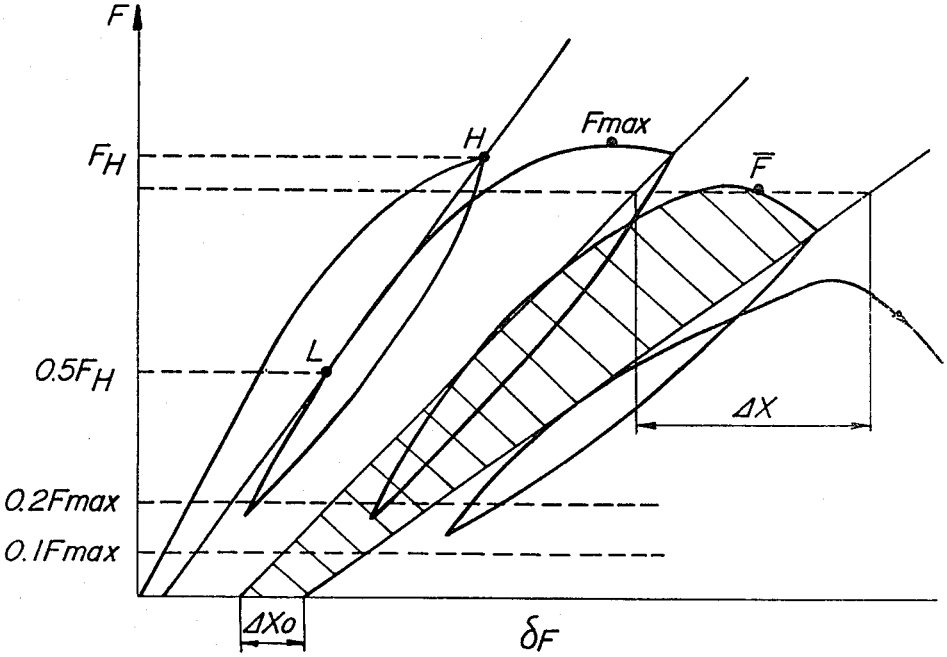
FIG. 2 is a graph showing load-displacement ($F$-$\delta_F$) curves.

(i) the pressure effectivity factor h is unknown:

One test piece CB of FIG. 1A or SR of FIG. 1C is prepared by using a core taken from a portion of rock, and its fracture toughness $K_{IC}$ is determined by the ISRM core test method. The pressure effectivity factor h of the core boring machine is determined by the equation (15); namely, by substituting the following data in the equation (15), i.e., the thus measured fracture toughness $K_{IC}$, the stored bit face width B and the number of rows $\epsilon$ of the face stones 4, the measured bit revolving speed N, the supply pressure Q, and the drilling speed L at the above-mentioned portion of the rock.

Once the pressure effectivity factor h of the core boring machine is known, the fracture toughness KIC at an arbitrary portion of underground rock can be determined by substituting the bit revolving speed N, the supply pressure Q, and the drilling speed L at the arbitrary portion in the the equation (15).

(ii) When the pressure effectivity factor h is known:

In this Case, the fracture toughness $K_{IC}$ at an arbitrary portion of underground rock can be determined by substituting the following data into the equation (15), i.e., the physical properties of the core boring machine including the bit face width B, the number of face stone rows $\epsilon$, and the pressure effectivity factor h, as well as its operating conditions including the bit revolving speed N, the supply pressure Q, and the drilling speed L at the arbitrary portion.

Figure 8:
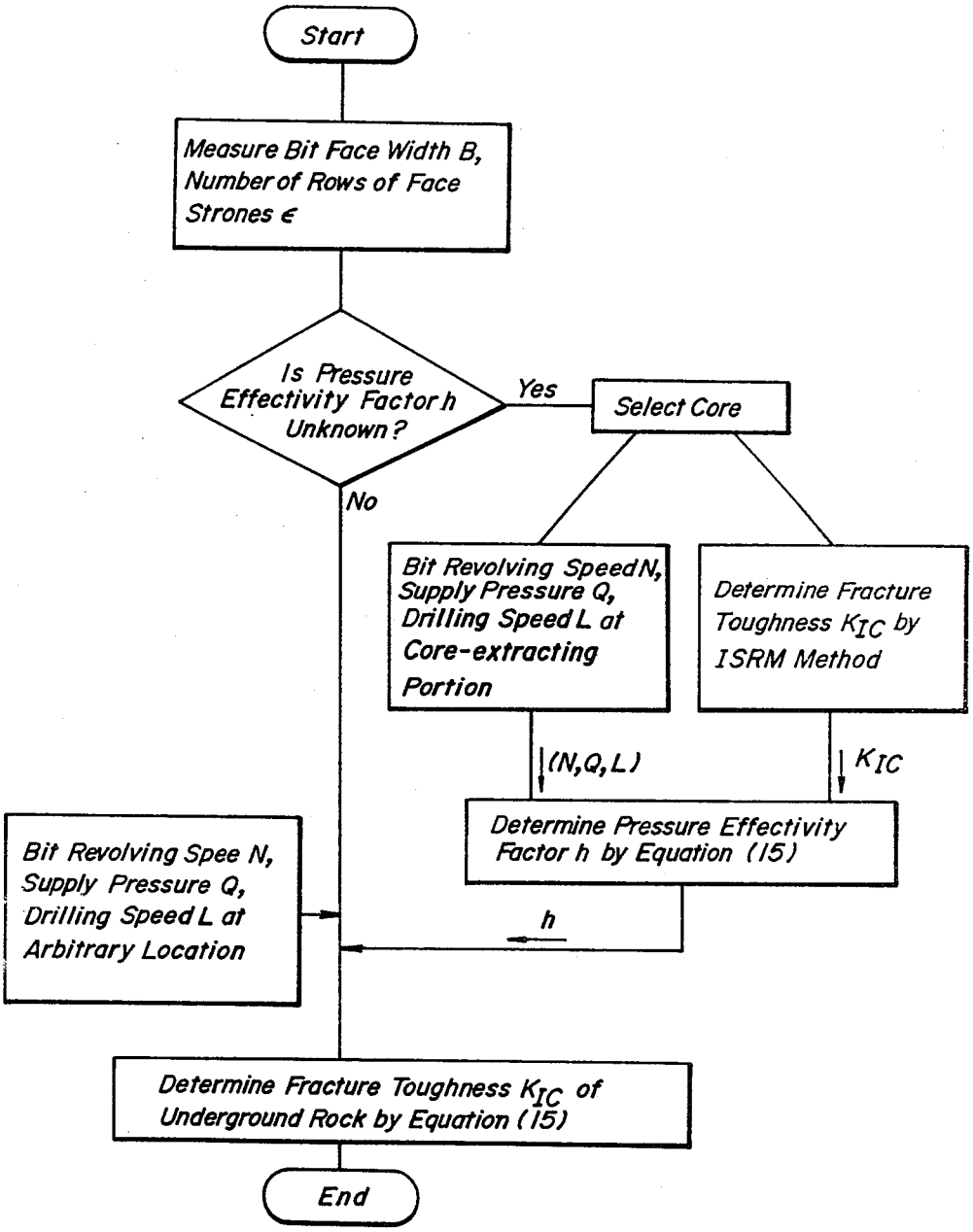
FIG. 8 is a flow chart of the method for determining rock fracture toughness $K_{IC}$ by core boring according to the invention.

The flow chart of FIG. 8 shows the steps of the process for determining the fracture toughness $K_{IC}$ in both of the above cases (i) and (ii).

Figure 9:
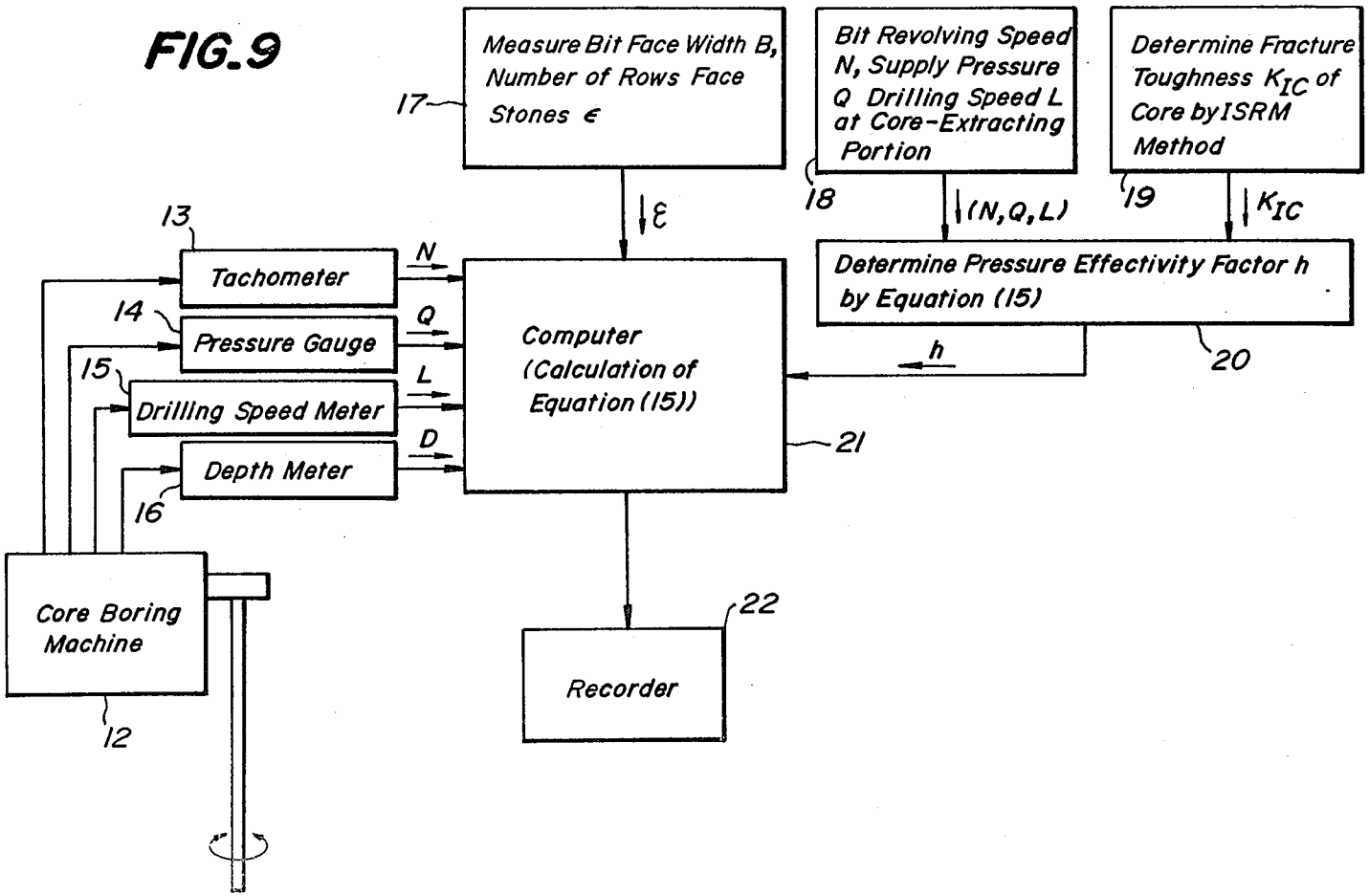
FIG. 9 is an overall block diagram of a system for measuring rock fracture toughness by the method according to the invention.

FIG. 9 shows an overall block diagram of a rock fracture toughness measuring system by core boring lased on the method according to the invention. A core boring machine 12 has a tachometer 13 for measuring the bit revolving speed N, a pressure gauge 14 for measuring the supply pressure Q, a drilling speed meter 15 for measuring the drilling speed L, and a depth meter 16 for measuring the depth D. Signals representing the measured values of the bit revolving speed N, the supply pressure Q, the drilling speed L, and the depth D are delivered to a computer 21 and stored thereat as the coring bit drills into the rock.

With the method of the invention, the bit face width B and the number of face stone rows $\epsilon$ of the coring bit of the boring machine are measured beforehand and stored in a memory 17. The memory 17 may or may not be a part of the computer 21. A core is taken from a certain portion of the rock, e.g., at a certain depth thereof, and the bit revolving speed B, the supply pressure Q, and the drilling speed L of the coring bit at the certain portion are measured and stored as shown by a block 18. The fracture toughness $K_{IC}$ of the core is measured by applying the ISRM test method as shown by a block 19. A block 20 is to determine the pressure effectivity factor h by the equation (15); namely, by substituting the bit revolving speed N, the supply pressure Q, and the drilling speed L from the block 18 and the fracture toughness $K_{IC}$ from the block 19 into the equation (15). The pressure effectivity factor h thus calculated is sent to the computer 21 for storage.

(II) EXAMPLE

Test cores were obtained by drilling a bore-hole at three depths in HACHIMANTAI TEST FIELD of TOHOKU UNIVERSITY. For comparison, the fracture toughness of the test cores were determined both by the ISRM core test method and by the method of the invention.

In the drilling of the bore-hole, a wire line coring bit HQ101 was used, which had an outside diameter of 101 mm and an inside diameter of 68 mm and 45 CT of diamond embedded therein. The rock type of the test cores and the conditions for drilling the test cores are summarized in Table 1.

TABLE 1

Rock type and drilling conditions of test cores

| Core No. | Depth m | Rock type | N* rpm | Q* KN | L* m/min |
|---|---|---|---|---|---|
| I | 352 | tuff of dithite type | 220 | 8.82 | 0.055 |
| II | 408 | " | 280 | 13.72 | 0.060 |
| III | 449 | tuffaceous sandstone | 315 | 13.23 | 0.052 |

*N is bit revolving speed, Q is supply pressure, and L is drilling speed.

The ISRM core test was applied to the test cores so as to determine their fracture toughness. The result is shown in Table 2.

The pressure effectivity factor h for each test core was calculated by using the equation (15) and the related data; namely, the thus determined fracture toughness, the bit revolving speed N, the supply pressure Q, and the drilling speed L of Table 1. The bit face width B was 16.5 mm and the number of face stone rows $\epsilon$ was 54. Consequently, an average pressure effectivity factor h of 0.34 was obtained. The frarture toughness of the test cores was calculated by the method of the invention; namely, by substituting the data of Table 1 and the average pressure effectivity factor into the equation (15). The result is also shown in Table 2.

TABLE 2

Fracture toughness as measured by ISRM method and as calculated by the method of the invention

| Core No. | Fracture toughness (MPam ½) ISRM method | method of invention |
|---|---|---|
| I | 0.06 | 0.54 |
| II | 0.77 | 0.91 |
| III | 1.03 | 0.99 |

The exploitation of geothermal energy from hot dry rock will become important in the future not only in Japan but also throughout the world. To this end, engineering technique for the design of underground heat exchange surface or crack is necessary, and it is indispensable to have adequate knowledge of the rock fracture toughness which is one of the fundamental physical properties ruling the behavior of underground cracks. Many volcanic countries including Japan have rich resources of geothermal energy, and the present invention is particularly important in those countries.

As described in detail in the foregoing, the present invention provides a method for determining rock fracture toughness $K_{IC}$ at different locations by calculation in an automatic and continuous manner, possibly during the core boring; namely, by using boring machine data such as the bit face width B and the number of face stone rows $\epsilon$ and by measuring the operating conditions, such as the bit revolving speed N, the supply pressure Q, and the drilling speed L. In short, the invention facilitates simplification, automatic measurement, continuous measurement, and automatic recording of rock fracture toughness $K_{IC}$.

Although the invention has been described with a certain degree of particularity by referring to a preferred embodiment, numerous modifications are possible in parts and construction without departing from the scope of the invention as hereinafter claimed.

What is claimed is:

1. A method for determining fracture toughness of rock by core boring, the method comprising steps of storing bit face width B of a coring bit and number of face stone rows $\epsilon$ on the boring bit;

preparing a test piece for fracture toughness measuring method of ISRM (International Society for Rock Mechanics) from a core produced by core boring with the coring bit at a portion of the rock while measuring and storing revolving speed N of the coring bit, pressure Q applied thereto, and drilling speed L at said portion;

fracturing the test piece by applying a load thereto so as to determine fracture toughness $K_{IC}$ of the test piece from the load and dimensions of the test piece in accordance with the ISRM method ;

calculating and storing a pressure effectivity factor h by an equation of $$K_{IC}=0.36\sqrt{N/\epsilon L}\cdot hQ/B \text{ ; and}$$

determining fracture toughness $K_{IC}$ of the rock at an arbitrary portion thereof by the core boring while using the above equation with the stored values of the number of face bit rows $\epsilon$, the face width B, and the pressure effectivity factor h, and with measured values of the bit revolving speed N, the supply pressure Q, and the drilling speed L of the boring machine thereat.

* * * * *